US005927805A

United States Patent [19]

Hilger et al.

[11] Patent Number: 5,927,805

[45] Date of Patent: Jul. 27, 1999

[54] STACKABLE CHILDREN'S HIGH-CHAIR

[75] Inventors: Jeff H. Hilger, Stillwater, Minn.; Mark A. Betker, Castle Rock, Colo.

[73] Assignee: Koala Corporation, Denver, Colo.

[21] Appl. No.: 08/844,549

[22] Filed: Apr. 18, 1997

[51] Int. Cl.[6] ..... A47C 3/04

[52] U.S. Cl. ..... 297/239; 297/148; 297/DIG. 2; 297/153; 297/451.12

[58] Field of Search ..... 297/239, DIG. 2, 297/149, 150, 148, 130, 451.12, 153

[56] References Cited

U.S. PATENT DOCUMENTS

| | | | |
|---|---|---|---|
| D. 157,066 | 1/1950 | Melzian . | |
| D. 169,271 | 4/1953 | McWaide . | |
| D. 177,231 | 3/1956 | Hail et al. . | |
| D. 182,052 | 2/1958 | Trebilcock . | |
| D. 193,337 | 8/1962 | Lebidine . | |
| D. 218,027 | 7/1970 | Obermeyer . | |
| D. 234,730 | 4/1975 | Lazo . | |
| D. 252,058 | 6/1979 | Patterson . | |
| D. 330,637 | 11/1992 | Takahashi et al. . | |
| D. 346,070 | 4/1994 | Kither . | |
| D. 348,156 | 6/1994 | Colyer . | |
| D. 355,755 | 2/1995 | Burstein . | |
| D. 356,689 | 3/1995 | Mariol . | |
| D. 362,971 | 10/1995 | Pacheco . | |
| D. 363,169 | 10/1995 | Burstein . | |
| D. 364,746 | 12/1995 | Lerner et al. . | |
| D. 373,683 | 9/1996 | Morgan | D6/339 |
| 2,544,760 | 3/1951 | Johnson | 297/467 |
| 2,874,755 | 2/1959 | Smith | 297/239 |
| 2,936,826 | 5/1960 | Reineman . | |
| 3,275,371 | 9/1966 | Rowland | 297/239 |
| 3,561,818 | 2/1971 | Lohmeyer . | |
| 3,604,749 | 9/1971 | Parmett et al. . | |
| 3,637,256 | 1/1972 | Harty . | |
| 3,899,207 | 8/1975 | Muller | 297/239 |
| 4,303,272 | 12/1981 | Berggren . | |
| 4,762,365 | 8/1988 | Grossfield | 297/130 |
| 5,044,691 | 9/1991 | Guichon . | |

*Primary Examiner*—Anthony D. Barfield
*Attorney, Agent, or Firm*—Sheridan Ross P.C.

[57] ABSTRACT

A children's stackable high-chair which is easily stackable and washable. One high-chair is integrally formed of a single piece of material and has a forward restraint secured thereto. A preferred high-chair includes a seat supported by two integral side vertical members, two lower, horizontal members, a rear horizontal member, and having a lower, frontal opening between the two vertical side members. The high-chair allows stacking requiring little vertical inclination and height of the high-chair to be stacked. The high-chair also allows stacking while creating only a small stacking angle from vertical. The high-chair allows stacking with only a relatively small increase in stack height for each high-chair relative to the height of each high-chair.

10 Claims, 10 Drawing Sheets

20
25
28
24
26
22
30
42
44
32
48
34
46
36
50
38
40
52
54
55
D1
56
64
66
58
62
60
70
D2
D3
68

20
35
34
74
92
58
90
86
83
66
85
84
D4

32
34
120
36
32
74
34
20
36
78
82
76
80

120
22
34
92
20
58
72
55
58
68

120
44
22
74
34
44
36
20
90
58
72
86
D1
55
D5
58
96
68
Ø
68

21
99
30
99
30
98
92
65

220
208
206
205
204
207
201
202
83
203
85
83
203
85

STACKABLE CHILDREN'S HIGH-CHAIR

FIELD OF THE INVENTION

The present invention relates generally to children's high-chairs. More specifically, the present invention relates to easily stackable children's high-chairs having a front open space extending to the floor.

BACKGROUND OF THE INVENTION

Children's high-chairs are commonplace. A chair significantly different from adult chairs is required for several reasons. A high-chair seat must be higher relative to a seat on adult chairs in order to raise the child or infant to a height so that they may be fed by a seated adult. A smaller seat is required to fit the smaller size of a child. Properly dimensioned leg rests and foot rests are also often found. This smaller size includes a sufficiently small front-to-back seat dimension, allowing the child's legs to bend at the knees. Seat sides and a front restraint are also usually found. A tray is frequently included as well, commonly removably attached to the high-chair.

High-chairs for home use are composed of many parts, assembled in traditional ways using conventional fasteners and manufacturing techniques. A conventional appearance is among the most important properties for a high-chair in order for it to be accepted in the home-use market. Conventional high-chairs often have cracks, gaps, crevices, and other discontinuities as a result of the design. These include discontinuities where two planes of material join, where parts swivel or rotate, and where fasteners penetrate holes. These discontinuities make the high-chair more difficult to clean.

In institutional settings, such as restaurants, ease of cleaning becomes very important. This is true for several reasons. First, time spent cleaning translates into labor costs. Second, less care is often spent by the adults using the high-chair, as the high-chair must be maintained by another party. Third, an institutional high chair may be used serially by a large number of users. Fourth, children unknown and unrelated to one another use a given high-chair, one after the other, all in various states of health. This increases the importance of having an easy to clean high-chair. In an institution such as a hospital, the ease of cleaning and substantially disinfecting a high-chair is of more importance due to the increased likelihood of diseases and the increased likelihood of susceptibility to contagious diseases due to poor health of some users.

Stackability assumes greater importance in institutional settings due to economic forces. The demand for high-chairs varies significantly with time. At some times, as when senior citizen traffic is high, few of the high-chairs are in use. At other times, when family traffic is higher, demand for high-chairs is heavy. The wide swings in high-chair demand in institutions is met by keeping high-chairs out of the way when they are not needed. Stacking is a preferred method of storing as multiple high-chairs can be stored above the same floor space. In restaurants in particular, revenue per square foot is an important measure of productivity, and floor space utilized for storing high-chairs is floor space that could have been used for seating to produce revenue.

Stacking is not a problem-free solution however. High-chairs can be heavy, especially sturdy high-chairs. Stacking and unstacking a high-chair requires lifting the high-chair to a height sufficient to cause one high-chair to slide over another. The stacking commonly requires lifting one high-chair almost vertically over another and dropping the high-chair. The unstacking commonly requires vertically lifting the top high-chair to a height sufficient to clear the high-chair below.

The above described method can be hard on the back of the lifter. The above-described required stacking and unstacking often limits the height to which chairs can be stacked. What would be desirable is a high-chair that can be stacked without requiring the high-chair to be lifted entirely over another, identical high-chair. What has not heretofore been provided is a high-chair stackable largely by moving one high-chair substantially horizontally over another high-chair. What would also be desirable is an easily cleanable high-chair that is formed as a single, integral piece.

SUMMARY OF THE INVENTION

The present invention includes childrens', stackable high-chairs. Preferred high-chairs include a seat having a back, seating surface, and sides, with the sides having arm rests thereupon. The seat is supported by vertical side members connected to lower, horizontal side members. One embodiment includes a lower, rear horizontal member connecting the two horizontal side members. Below the seat in a preferred embodiment is an intermediate horizontal member connecting the two vertical side members and acting as a leg rest. The leg rest can extend up to the seat and down to a horizontal ledge which can act as a foot rest.

The bottom of the intermediate horizontal member defines the top of a frontal opening between the vertical side members. The bottom, side horizontal members define a bottom opening. A preferred high-chair further includes a forward restraint secured to the seat bottom and sides. The high-chair can also include side channels in the seat back sides for receiving the rearward extending arms of a food tray.

High-chairs according to the present invention are preferably formed as a single, integral piece, with the later addition of a forward restraint. The high chairs can be formed of a polymeric material using a blow-molding or rotational molding process. A preferred polymer is high density polyethylene. The integral construction provides a strong, easily cleaned high-chair. While high-chairs in accordance with the present invention have improved properties well suited to institutional use, home use is also contemplated and is within the scope of the invention.

In use, the high-chairs can be stacked by holding a first, primarily horizontal, upper high-chair over a second, vertical, lower high-chair. With a relatively low height and low angle of inclination relative to horizontal, the upper high-chair can be slipped over the lower high-chair. This provides an easily stacked high-chair requiring little lifting or awkward positions that can cause back strain. The frontal opening allows the upper high-chair to partially slip over the bottom high-chair while still primarily horizontal and at a moderate height. The frontal opening also allows the inclusion of a foot rest in the front of a stackable high-chair.

High-chairs according to the present invention can be stacked with a small stacking angle relative to vertical. This reduces the cumulative horizontal creep and instability of a large number of stacked chairs. The high-chairs can also be stacked with a relatively small addition to height with each added chair. A preferred high-chair adds less than about one-third of its height relative the height of the high-chair alone. The relatively small stacking angle and small additional stacking height allows for an increased number of high-chairs to be stacked without straining a person's back.

DETAILED DESCRIPTION OF THE PREFERRED EMBODIMENTS

Figure 1:
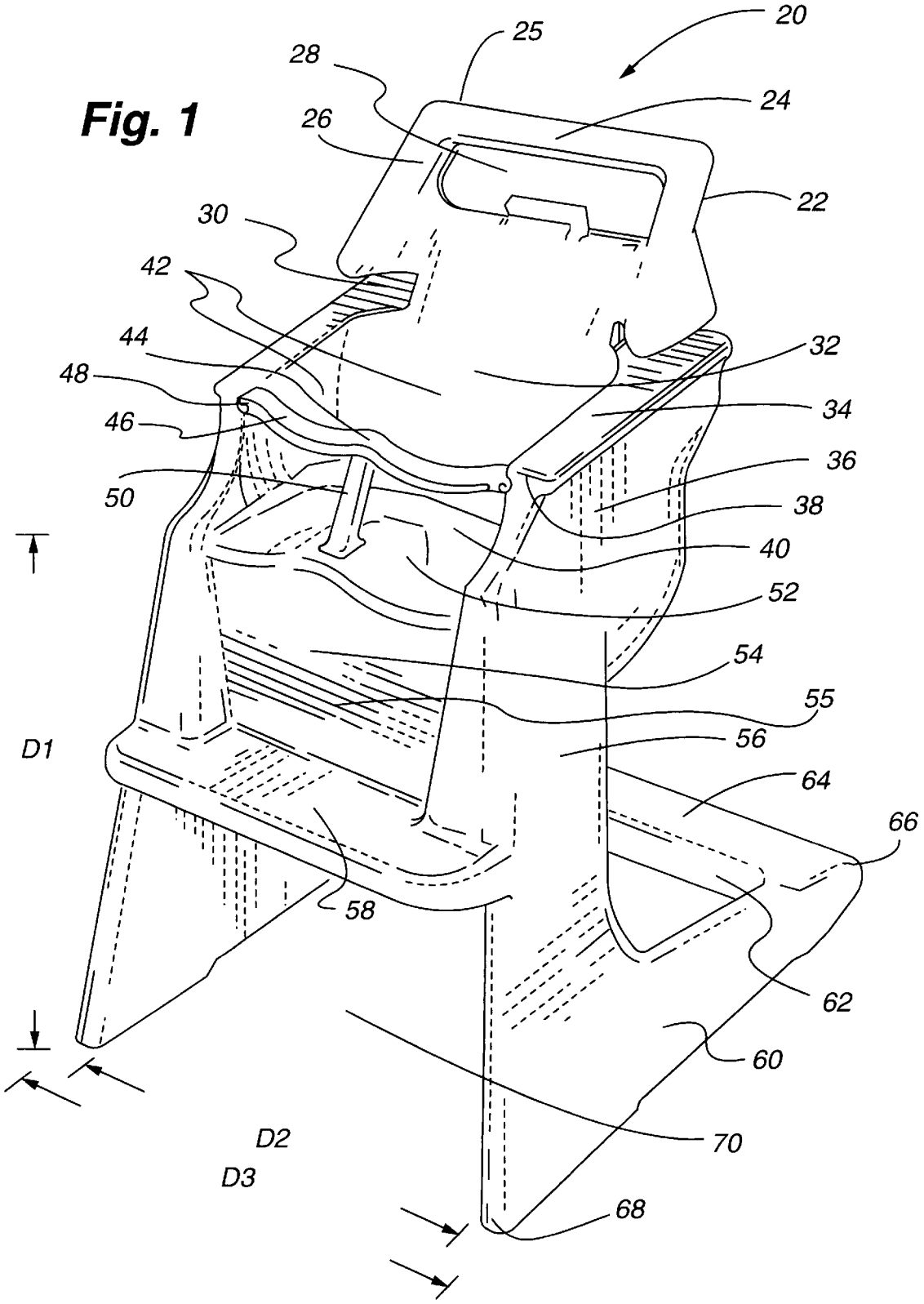
FIG. 1 is a perspective view taken from the left-front of a high-chair according to the present invention.

FIG. 1 illustrates a childrens' high-chair 20 according to the present invention. High-chair 20 includes a seat 52 having a substantially vertical seat back 32, a substantially horizontal seating surface 40, two substantially vertical sides 36, a seat front surface 42, and a seat back extended top portion 22. Seat back extended top portion 22 includes a top horizontal member 24, two vertical members 26, which, together with the remainder of seat back 32 defines a seat back top space 28, which allows grasping of horizontal member 24. The top of horizontal member 24 includes a top face 25, which, in the embodiment illustrated, is the top most extent of high-chair 20.

Two, substantially vertical side members 56 extend down from, and are preferably integrally connected to, seat 52. An intermediate, horizontal member or leg rest 54 extends horizontally between side members 56, and has a substantially vertical outside face 55. A substantially horizontal foot rest 58 is connected to the bottom of leg rest 54. In a preferred embodiment, foot rest 58 is integrally formed with leg rest 54 and side members 56 and protrudes forward of leg rest 54 and side members 56. The bottom of foot rest 58, the inside of vertical members 56, and the floor, or surface on which the chair rests, define a front space 70, having, at front, a side-to-side dimension D2 between vertical side members 56, where vertical side-members have a front outside dimension D3. In the embodiment illustrated, horizontal seating surface 40 is a distance D1 from the ground, to provide proper infant height for attending adults.

Seat 52 includes arm rest surfaces 34 on top of seat sides 36, where arm rests 34 come forward to seat side front corners 38. Seat 52 has attached a forward restraint 44, which includes a horizontal member 46 and vertical member 50, and seat sides 36 include side channels 48 adapted to receive the opposite arms of forward restraint 44. Seat back 32 includes seat-back side channels 30, for receiving the rearward extending arms of a food tray (see, FIGS. 9 and 10).

At its base or bottom, high-chair 20 includes horizontal side members 60 extending from front, lower corners 68 to rear, lower corners 66. Extending between the rear portion of horizontal side members 60 is a rear, horizontal member or rear member 64 having a rear member inside face 62. With the exception of forward restraint 44, in the preferred embodiment, the exterior surface of high-chair 20 is integrally formed of a single, monolithic piece of material. A preferred high-chair has seat, leg rest, foot rest, seat back, seat sides, side members and rear member formed integrally with one another and hollow within, providing strength with less weight and material than possible with solid construction. A preferred method of manufacture utilizes rotational or blow molding and a polymeric material. The preferred polymer is a high density polyethylene. In one embodiment, forward restraint 44 is attached to high-chair 20 using chemical bonding and/or mechanical fasteners. Chemical bonding alone, forming a smooth, easy to clean joint which does not trap food, is preferred. The continuous material construction provides a high-chair which is easy to clean and can be sprayed without trapping water or food debris within cracks and fastening holes.

Figure 2:
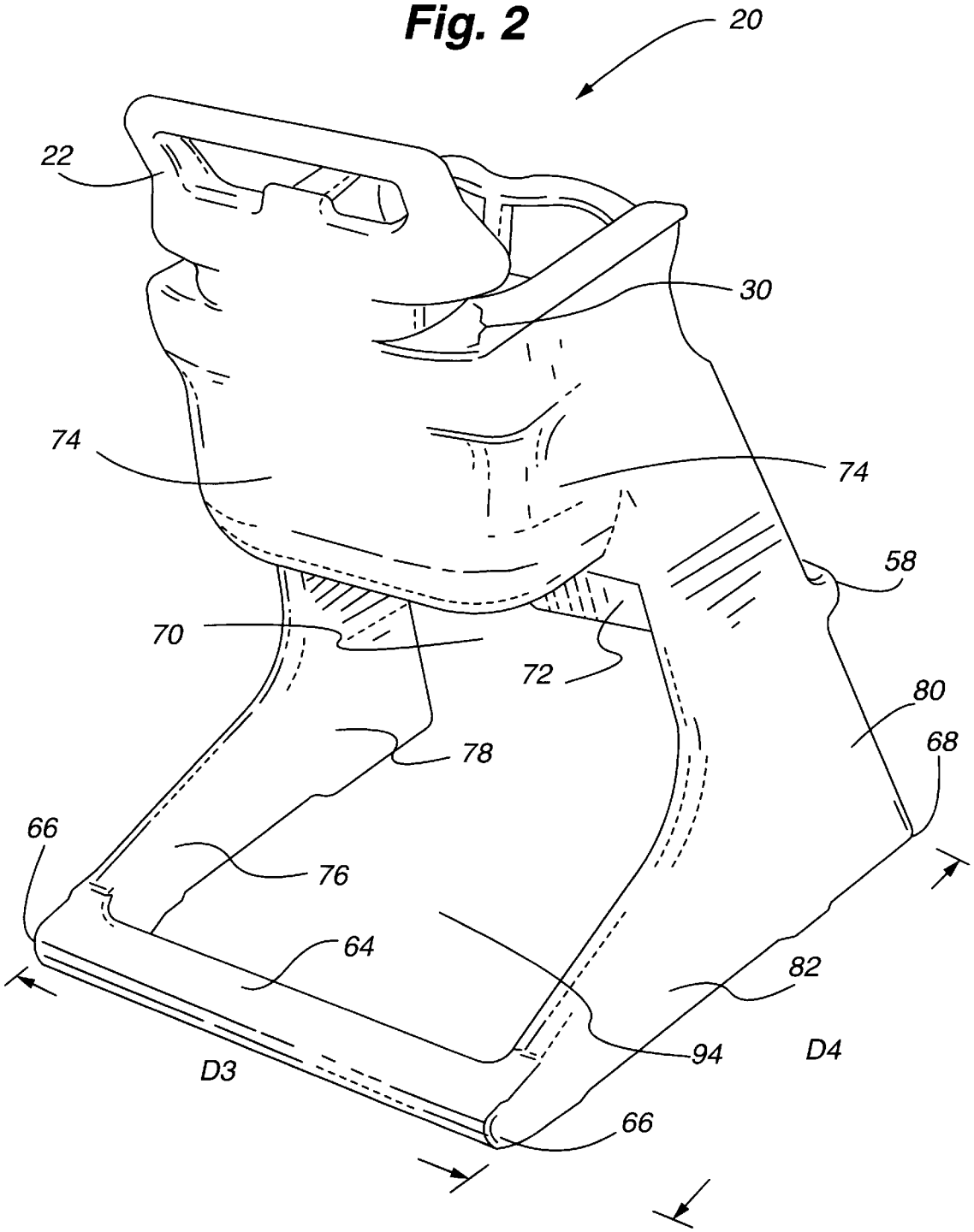
FIG. 2 is a perspective view taken from the right-rear of the high-chair of FIG. 1.

Referring now to FIG. 2, high-chair 20 depicted in FIG. 1 is illustrated from the right-rear direction. Seat 52 is shown having a rear surface 74. Seat back side channels 30 are also shown from the rear. Foot rest 58 includes a foot rest rear face 72. Front space 70 is shown from the rear direction. Side vertical members 56 have outside faces 80 and inside faces 78. Side horizontal members 60 have outside faces 82 and inside faces 76. A bottom space 94 is defined by the interior of an area bounded by side members 56 and 60, rear member 64, and front corners 68. High-chair 20 has a side dimension D4 defined by the distance from rear corners 66 to front corners 68.

Figure 3:
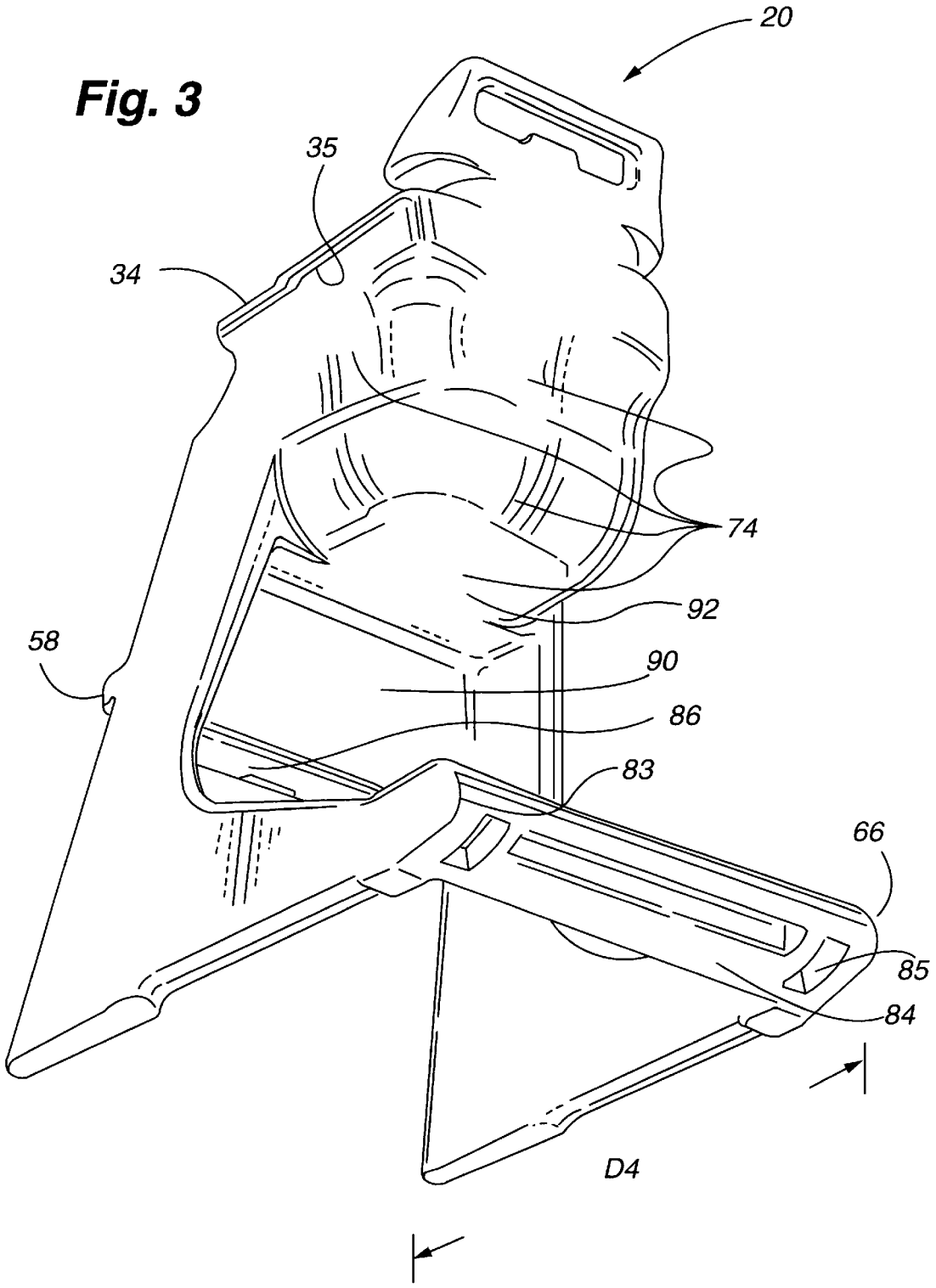
FIG. 3 is a perspective view taken from the lower-left-rear of the high-chair of FIG. 1.

Referring now to FIG. 3, high-chair 20 is illustrated from the bottom, rear left. Side dimension D4 is shown clearly as is a rear member bottom face 84. A bottom face 86 of foot rest 58 is also shown. A rear face 90 to the leg rest is shown as is a bottom surface portion 92 to seat rear surface 74. Two wheel recesses 85 are shown, for optional mounting of rear wheels. Rear lower corners 66 have a rounded portion 83, to allow for more easily tilting the high-chair backwards. Seat arm rest 34 can also include an arm rest flange 35.

Figure 4:
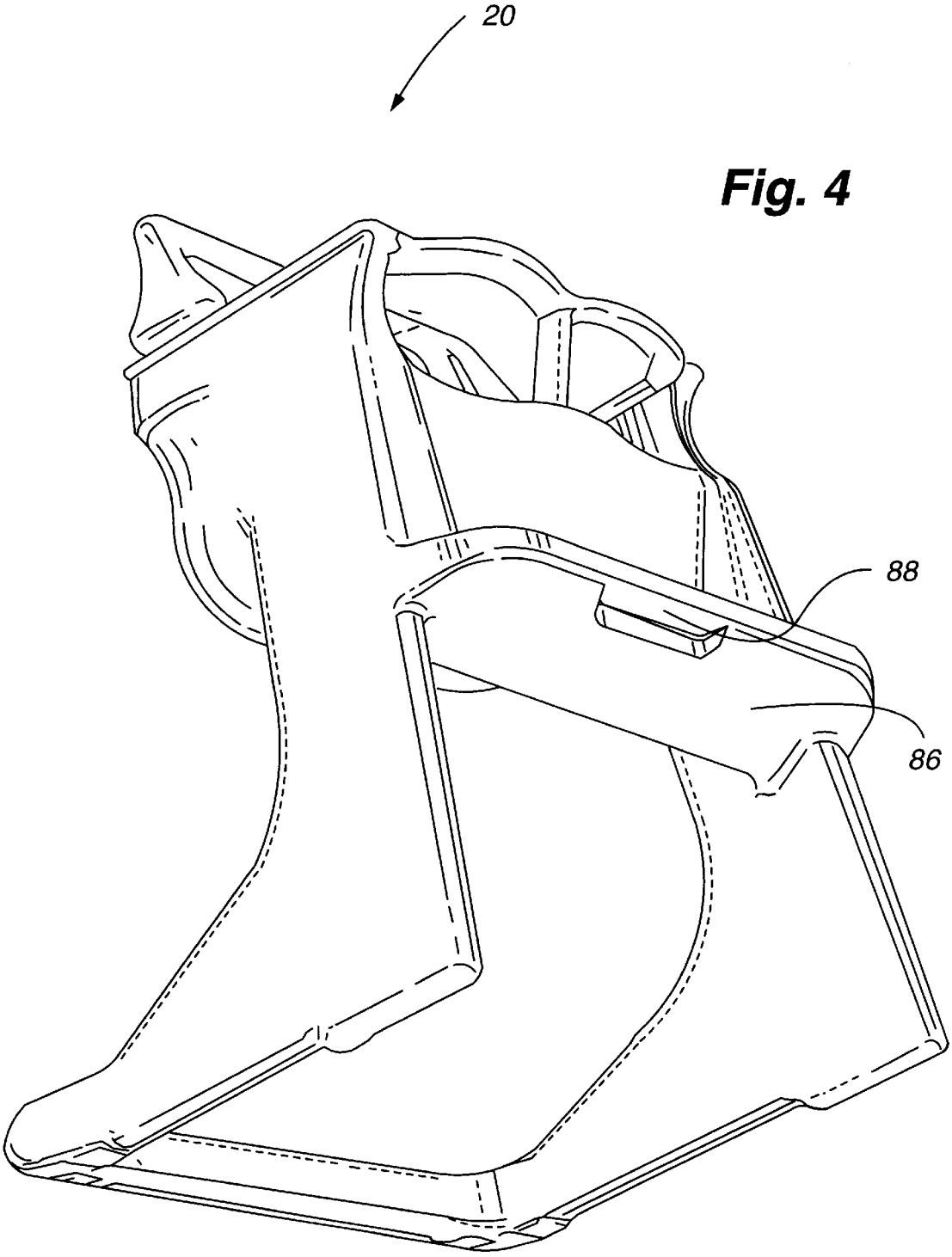
FIG. 4 is a perspective view taken from the lower-left-front of the high-chair of FIG. 1.

Referring now to FIG. 4, high-chair 20 is illustrated from the bottom, left front direction. Foot rest bottom face 86 includes a foot rest hand recess 88, for easier grasping.

Figure 5:
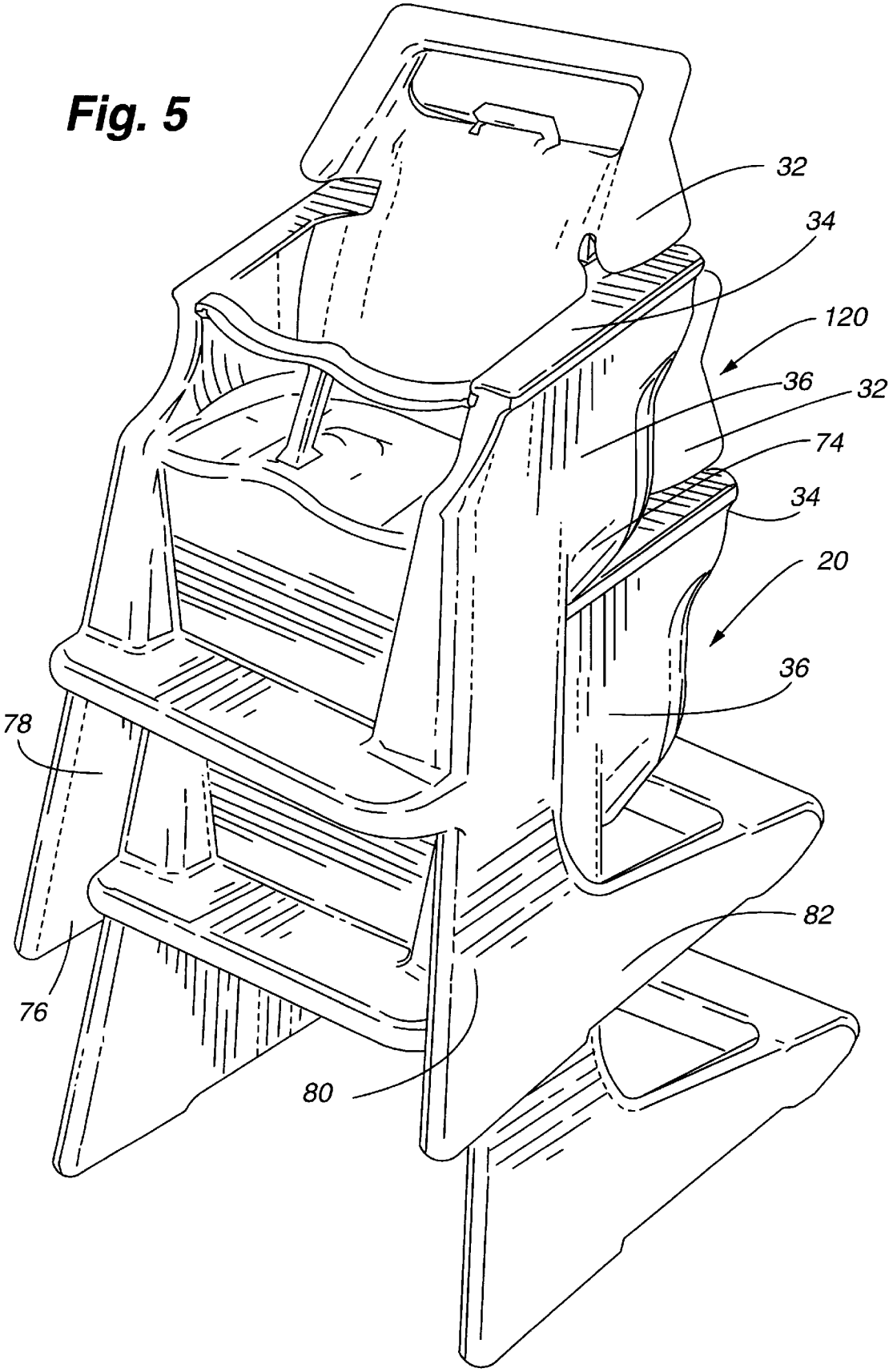
FIG. 5 is a perspective view taken from the left-front of two, stacked high-chairs of FIG. 1.

FIG. 5 illustrates two, identical chairs 20 and 120. Top high-chair 120 is resting upon bottom high-chair 20, with seat rear surface 74 resting upon the surface of arm rest 34 and seat back 32. The inside faces 76 and 78 of the side members are seen to fit over the outside faces 80 and 82 of the side members.

Figure 6:
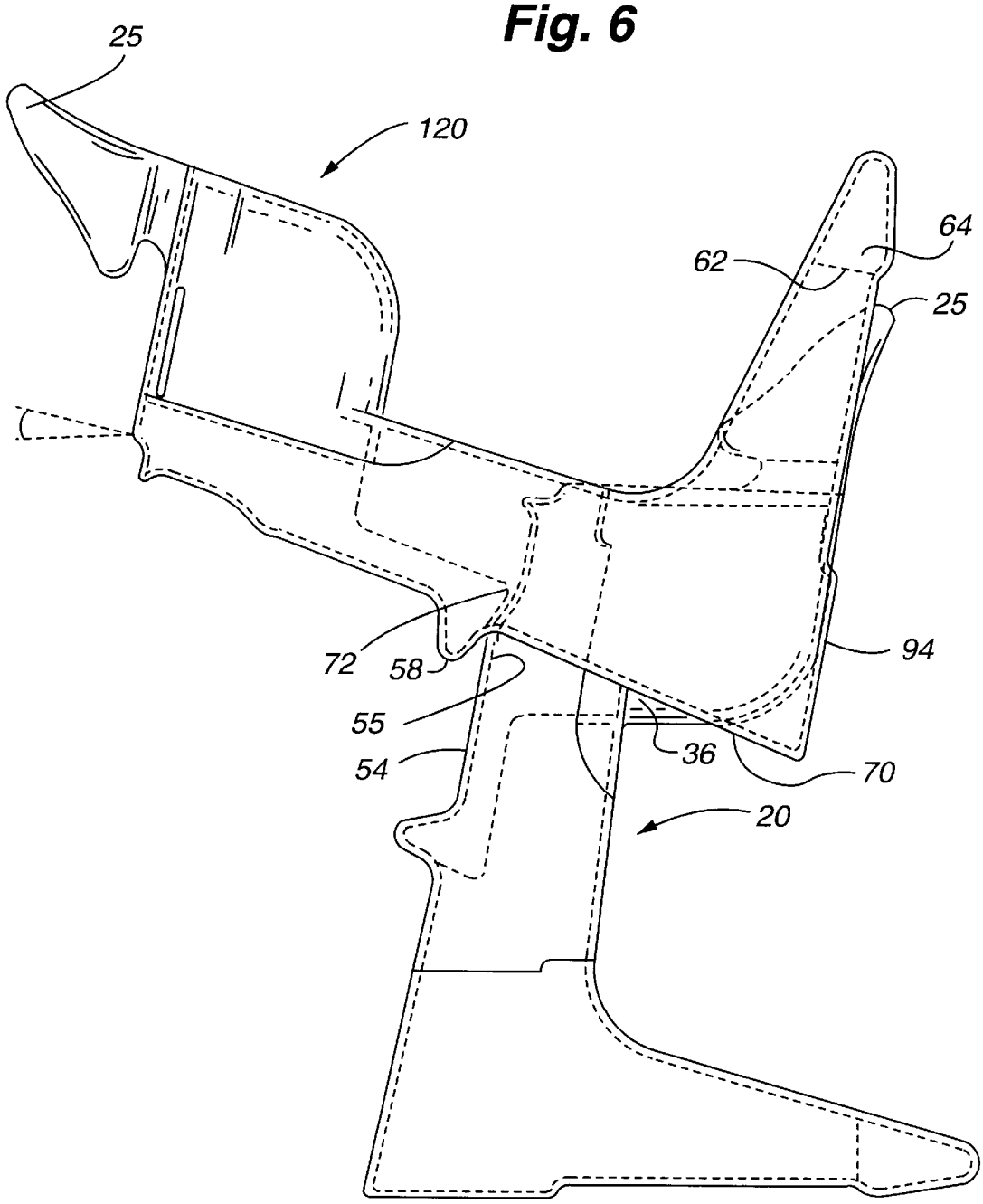
FIG. 6 is a side-view of two high-chairs as depicted in FIG. 1, in the process of being stacked, with hidden profiles shown in phantom.

Referring now to FIG. 6, high-chair 120 is shown being stacked upon high-chair 20. Upper high-chair 120 has been maneuvered such that bottom space 94 and front space 70 have been passed over the seat sides 36 of lower high-chair 20. The inside face 62 of rear member 64 has been positioned over seat back upper face 25. The rear face 72 of upper high-chair foot rest 58 is positioned near the outside face 55 of leg rest 54.

A high-chair axis may be defined as running through some central point in the high-chair and being perpendicular to the ground when the high-chair is setting upon the ground. An angle of inclination from horizontal may be defined as the angle the high-chair axis has with respect to horizontal at any given time. An angle of inclination $\theta$ is shown in FIG. 6, illustrating how close upper high-chair 120 may be to horizontal and still be stacked upon lower high-chair 20. With relatively minor rotation of high-chair 120, rear member 64 will completely clear seat top 25. With relatively little momentum, high-chair 120 will completely settle over lower high-chair 20.

In use, one hand of a person stacking may be placed upon horizontal side member 60 near rear member 64 and one hand upon upper high-chair seat back side vertical member 26. High-chair 120 may then be swung almost horizontally over the sides of lower high-chair 20. As the foot rest of the upper high-chair approaches the front of the lower high-chair, the stacker's hand on the seat top can be pitched briefly upward, arcing the high-chair seat top upward, thus requiring only a small deviation from horizontal. With momentum and follow through, rear member 64 will clear seat top 25 and upper high-chair 120 will settle over lower high-chair 20. This stacking can be accomplished in one fluid motion, allowing the stacker to maintain balance through all of the stacking motion. The upper high-chair does not need to be raised vertically over the lower high-chair for stacking. The maneuvering required to stack the present invention may be compared with stacking high-chairs not having open space 70 in the front. In such a non-open high-chair, a more vertical orientation is required to put the upper high-chair in a position where gravity will take over, settling the upper high-chair onto the bottom high-chair. This requires raising the seat of the upper high-chair higher into the air to even approach the point where the rear member of such an upper high-chair could be slipped over the seat top of a lower high-chair.

From inspection of FIG. 6, it may be seen that having no open space 70 in front high-chair 120 would require rotating high-chair 120 to a much greater angle before slipping the upper high-chair over the lower. It may also be seen from FIG. 6 that a high-chair 120 according to the present invention, if desired, could also be held perfectly vertical and lifted over lower high-chair 20 before settling over the lower high-chair.

A minimum static angle of inclination may be defined as the minimum angle from horizontal from which a negligibly moving high-chair may be stacked upon another, identical high-chair. In one embodiment of this invention, this angle is about 30 degrees. In another embodiment of this invention, this angle is about 35 degrees. A minimum dynamic angle of inclination may be defined as the minimum angle from horizontal from which a fast moving high-chair may be stacked upon another, identical high-chair. In one embodiment of this invention, this angle is about 0 degrees. In another embodiment of this invention, this angle is about 10 degrees. This angle takes into account some of the horizontal momentum of the high-chair being translated into rotational energy when the upper high-chair contacts the lower high-chair, assuming the rear member of the upper high-chair is sufficiently high to clear the seat back top of the lower high-chair.

Figure 7:
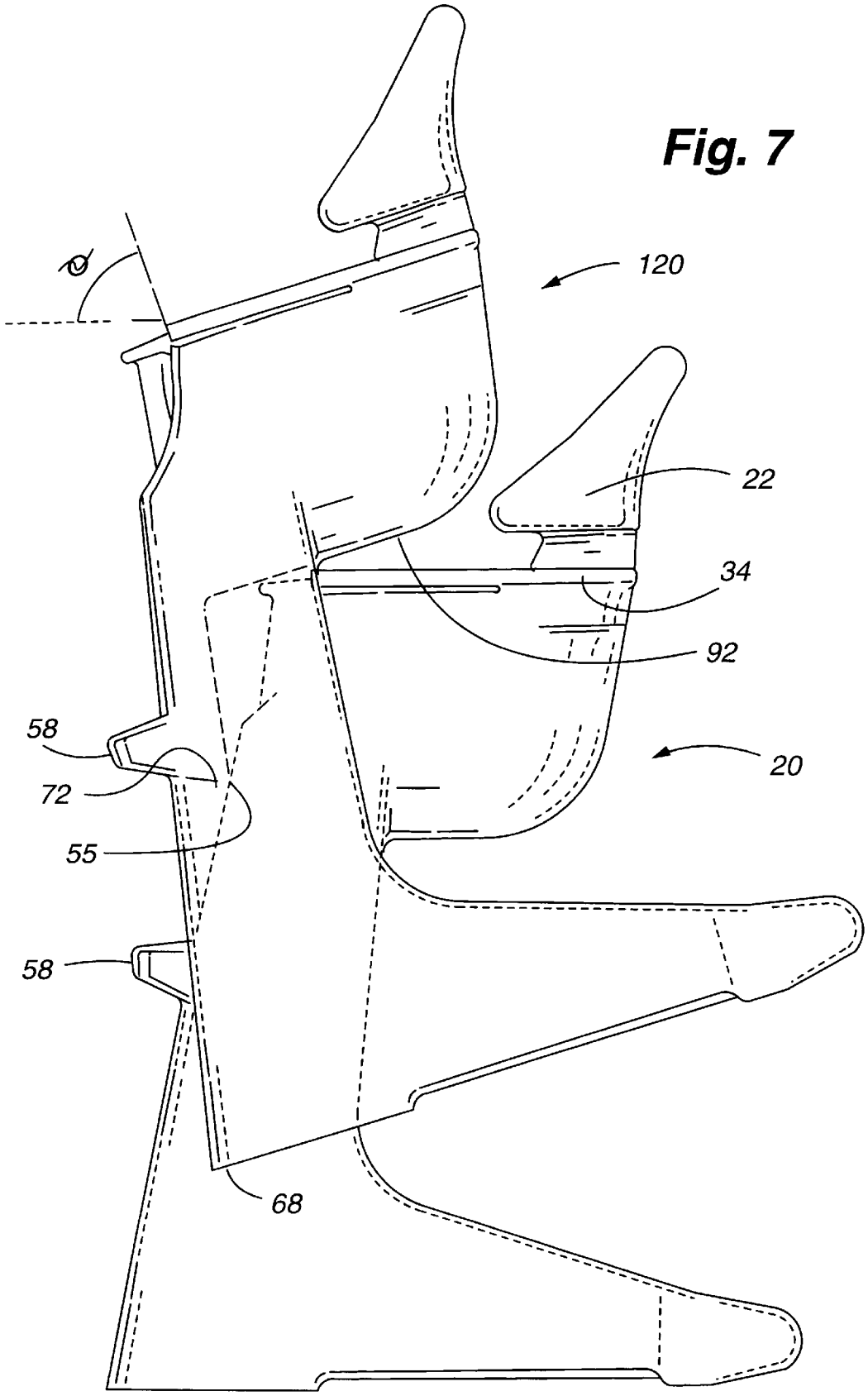
FIG. 7 is a side-view of two high-chairs as depicted in FIG. 1 further into the process of being stacked than in FIG. 6, with hidden profiles shown in phantom.

Referring now to FIG. 7, upper high-chair 120 is more completely settled onto lower high-chair 20. The rear face 72 of upper foot rest 58 may be seen to be limited in rearward movement by the outside face 55 of leg rest 54. Seat rear surface 92 has not yet come to rest on seat arm rests 34. The importance of the front space in the upper high-chair is once again illustrated, allowing front corner 68 of the upper high-chair to allow rotation of upper high-chair 120. Upper high-chair 120 has an angle of inclination from horizontal θ in FIG. 7.

Figure 8:
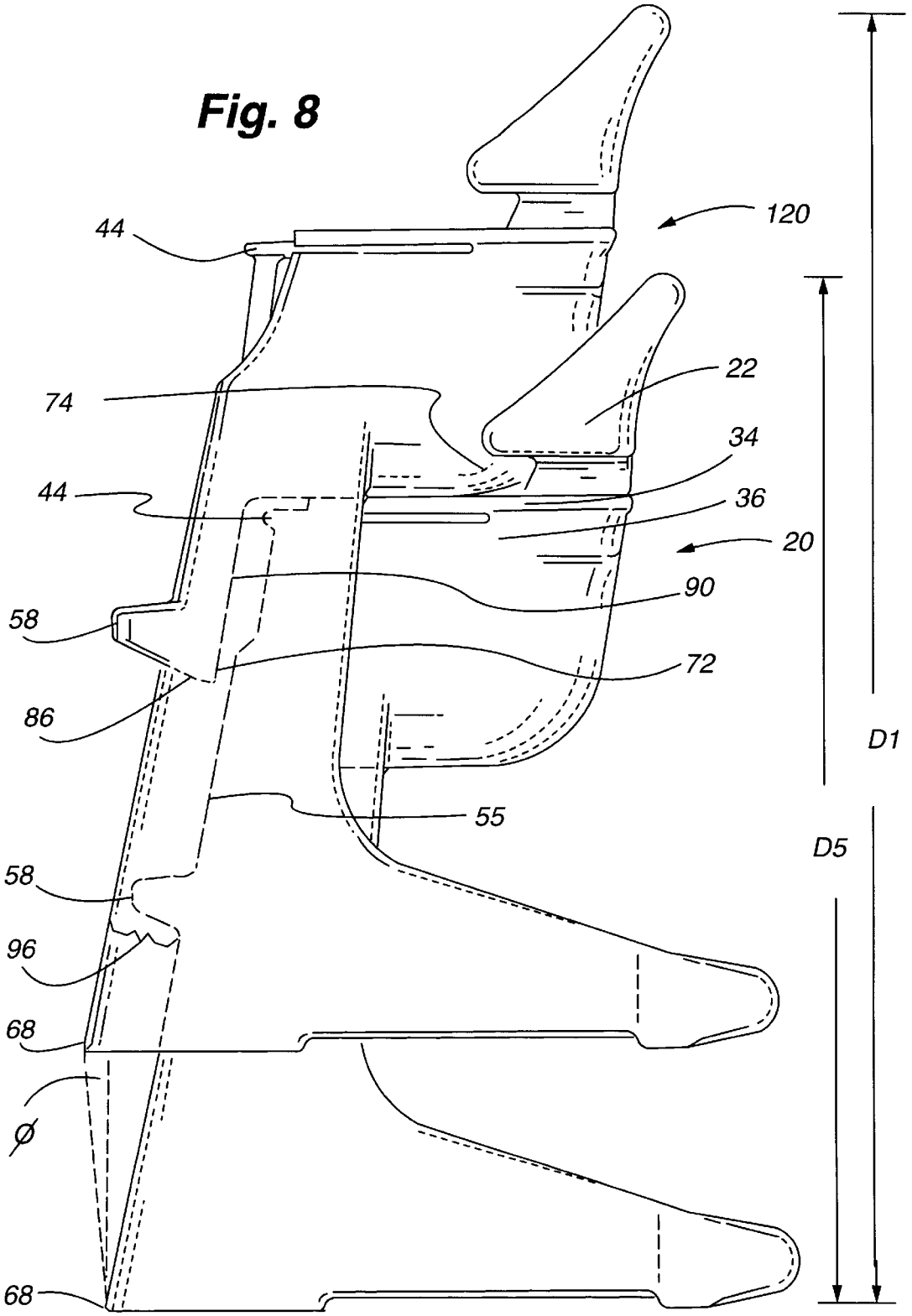
FIG. 8 is a side-view of two, completely stacked high-chairs of FIG. 1, with hidden profiles shown in phantom.

Referring now to FIG. 8, upper high-chair 120 is stacked upon lower high-chair 20. The rear surface 74 of upper high-chair 120 is seen to rest on arm rests 34 and near seat back extended top portion 22. The relationship between leg rest rear inside surface 90, foot rest rear face 72, and the lower high-chair is illustrated. A distance 96, showing the distance that foot rest 58 protrudes into the space of the side members, is also illustrated. Distance 96 also illustrates the importance of having front space 70 which allows inclusion of a foot rest in a stacking high-chair.

It may be seen from FIG. 8 that while the high-chairs have side vertical members that angle rearward, when stacked, the high-chair stack is more nearly vertical. A "stacking angle" may be defined as the deviation of the high-chair axis from vertical caused by stacking one high-chair upon another high-chair. Stacking angle ϕ in FIG. 8 is formed by drawing a line from front corner 68 of lower high-chair 20 to front corner 68 of upper high-chair 120. In one embodiment, this stacking angle is about 20 degrees. In another embodiment, this stacking angle is about 25 degrees. In a preferred embodiment, the stacking angle is about 20 degrees. In one embodiment, each stacked chair is about 4½ inches forward of the chair beneath, and each chair is oriented vertically upright, similar to a chair on a level floor. The small stacking angle allows stacking more chairs in a limited vertical space before the cumulative horizontal deviation causes a stacking problem.

Lower high-chair 20 has a height D5. The combined, stacked height of the two high-chairs in FIG. 8 is D6. A smaller stacking height percentage increase of D6 relative to D5 can translate into a larger number of high-chairs stackable within a given height. In a preferred embodiment, the stacking height percent increase is less than 30%. This means that each added high-chair adds less than about one third of a high-chair height. This also allows for easier stacking with less lifting and back strain. In one embodiment, one chair is about 34¾ inches high at the top of the back rest, and two stacked chairs are about 44½ inches high.

Figure 9:
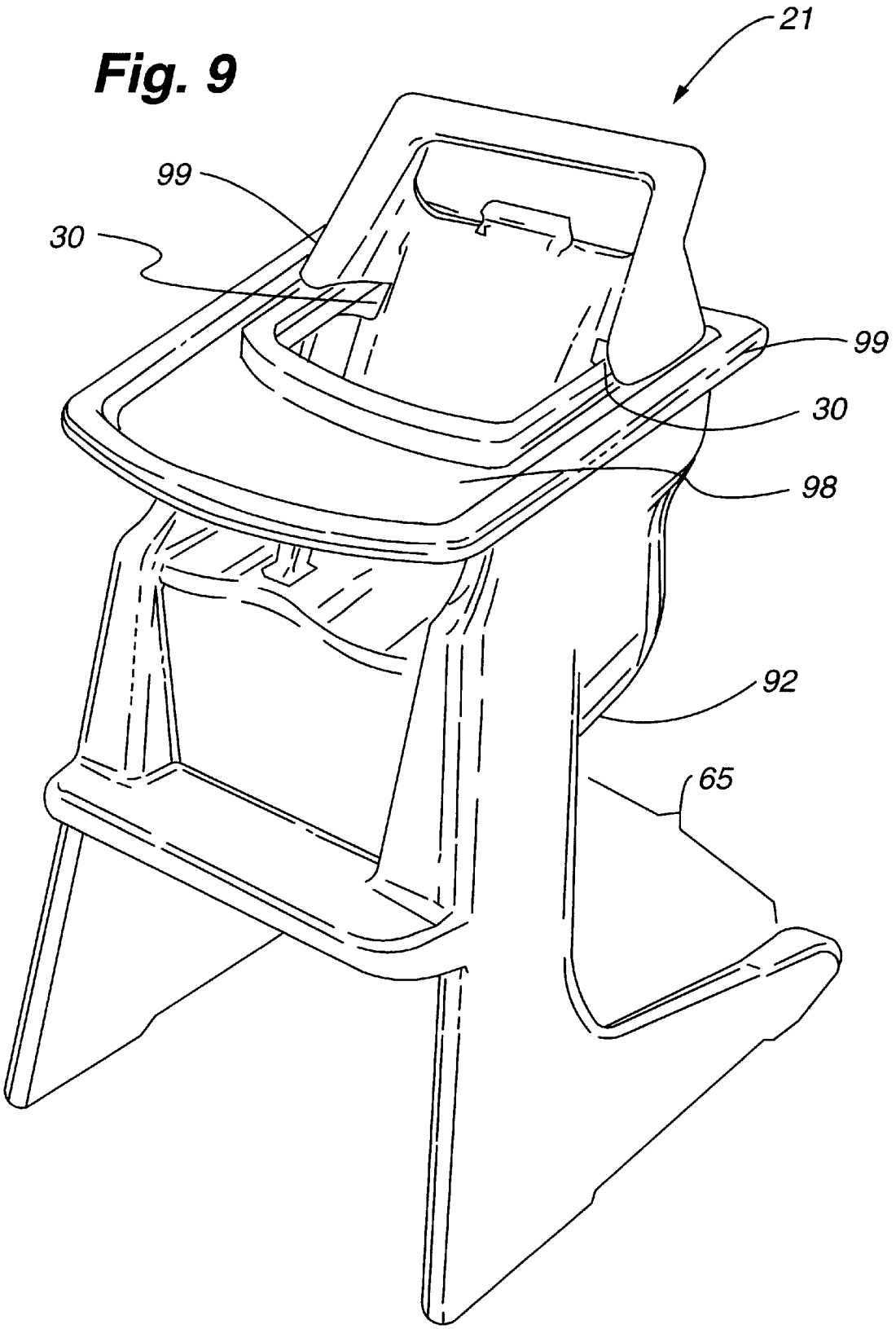
FIG. 9 is a perspective view taken from the left-front of a high-chair according to the present invention having a tray and no rear horizontal member.

Referring now to FIG. 9, another embodiment of the invention is illustrated in high-chair 21. High-chair 21 is similar to high-chair 20, previously illustrated, but has a rear open space 65 in place of a rear member. A food tray 98 having rearward extending arms 99 is also illustrated. Rearward arms 99 extend through channels 30. Tray 98 is also suitable for use with high-chairs such as high-chair 20, as illustrated in FIG. 1. Rear space 65 allows for stacking with a very high angle of deviation relative to vertical. With high-chair 20, it is necessary to raise rear member 64 over the seat top of the lower high-chair. With high-chair 21, this is not necessary. High-chair 21 requires that seat rear surface bottom 92 be lifted up to arm rests 34. This can result in a very easy to stack high-chair, requiring very little lifting to accomplish stacking.

Figure 10:
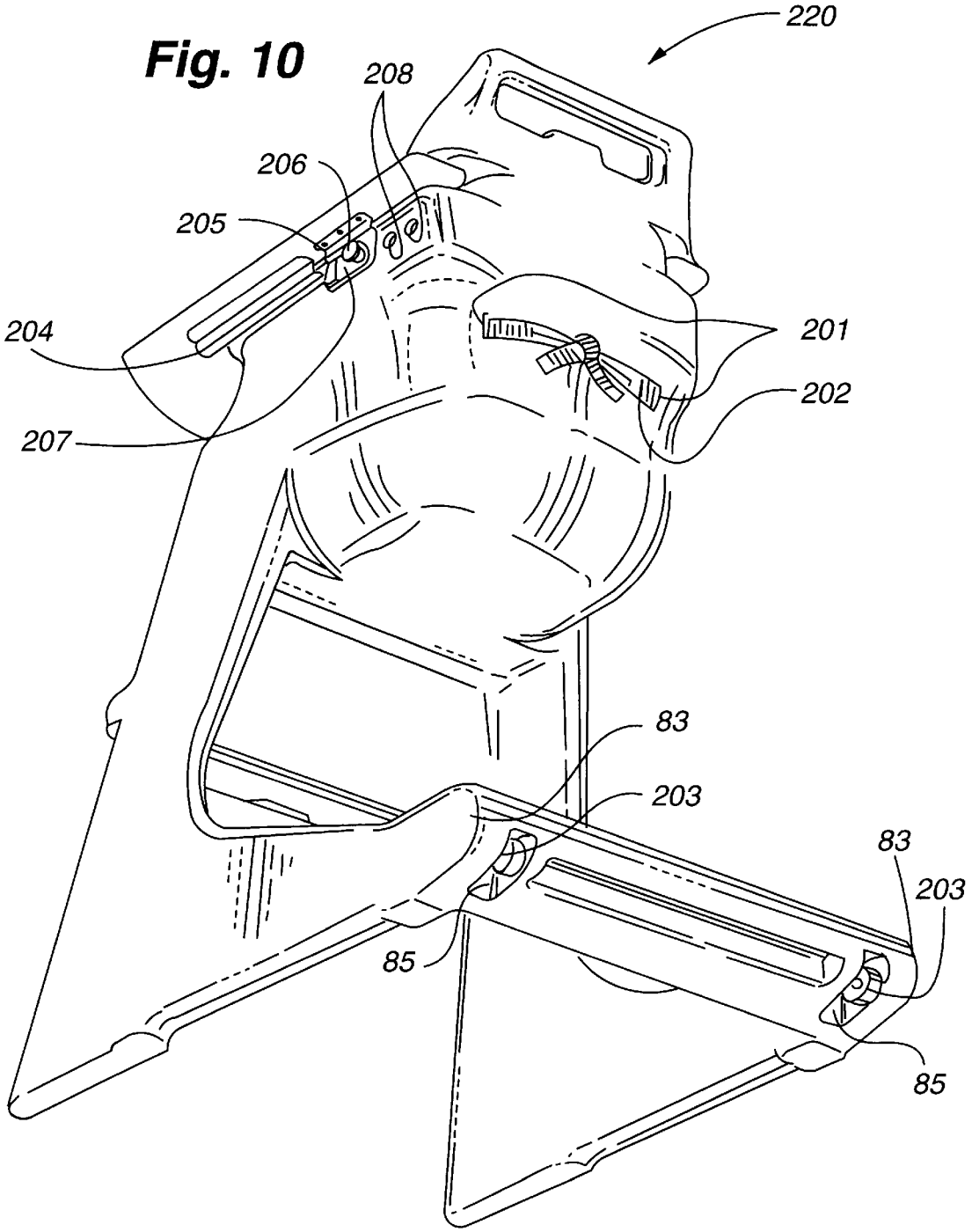
FIG. 10 is a perspective view taken from the lower-left-rear of a high-chair having tray hardware, lap belt and rear wheels.

Referring now to FIG. 10, a high-chair embodiment 220 is illustrated, having two rear wheels 203 mounted within rear wheel recesses 85 in rear horizontal member 64. Wheel recesses 85 are preferably open to the rear and bottom, and can be formed as part of the original shape by blow molding or injection molding. A wheel such as wheel 203 can be mounted within recess 85 by inserting a wheel having an open hub into recess 85 and inserting a rod or axle, through side member 60 near corner 66, and further through the wheel hub and into the side of the recess.

In a preferred embodiment, wheel 203 is mounted in rounded region 83 of side member 60, and is mounted with the axle sufficiently vertically displaced, and sufficiently close to the chair rear, such that the wheel does not contact the floor when the chair is level, but does contact the floor when the chair is tilted backwards for moving the chair. In this way, the chair presents resistance to rolling when used for seating, but allows for easily rolling the tilted, wheeled chair across a room, using only one hand on the seat back top horizontal member.

In a preferred embodiment, a tray 209 can be removably secured to chair arm rest flanges 35 with a front tray bracket 204 attached to the front portion of tray rearward arms 210. Brackets 204 slidably receive flanges 35. In one embodiment, a set of rear tray brackets 205 are attached to a rear portion of tray rearward arms 210, and include means for removably securing tray arms to holes 208 in the chair sides. In one embodiment, a pin 206 is biased with an elastic hinge member 207 to protrude inwardly through a hole in bracket 205, and into holes 208. Tray 209 can be slid in a rear direction over flanges 35 until pins 206 slide into holes 208, securing tray 209. A preferred embodiment includes slots 201 through seat back 32, for receiving the ends of a child's lap belt 202.

Numerous advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The inventions's scope is, of course, defined in the language in which the appended claims are expressed.

What is claimed is:

1. A stackable, substantially monolithic, seamless transportable high-chair, adapted for setting on a floor, comprising:

a seat, said seat comprising a seating surface, a seat back, and a rear surface positioned opposite said seating surface;

an arm rest integrally formed with and positioned on each side of said seat;

at least two generally vertical side members integrally formed with and operably interconnected to said seat;

a forward restraint device positioned proximate to a forward portion of said seat and interconnected to one of said seat or said arm rests;

at least two substantially horizontal side members integrally formed with and operably connected to said vertical side members and adapted for resting on said floor, wherein said vertical side members define a front space therebetween, said space having a substantial height for extending to said floor, wherein when a child is sitting on said seating surface, feet of said child do not touch the floor;

a rear member extending between and operably interconnected to said side horizontal members, said rear member adapted for contact with said floor for additional stability and defining an inside clearance sufficiently large to allow said high chair to be stacked upon a second, identical high chair in a substantially vertical relationship, wherein in a stacked position said rear surface of said high-chair is in contact with arm rests of said second, identical high chair; and at least one wheel interconnected to said rear member and adapted for operable contact with said floor when a forward portion of said stackable high-chair is raised in an upward direction, wherein when said stackable high-chair is in a normal position of use said wheel is elevated sufficiently to prevent contact with said floor.

2. A stackable high-chair as recited in claim 1, further comprising an intermediate horizontal member between said vertical side members, said intermediate horizontal member being integrally formed with said vertical side members, said intermediate horizontal member defining a top of said space.

3. A stackable high-chair as recited in claim 2, wherein said intermediate horizontal member includes a substantially horizontal foot rest surface extending forward of said vertical side members.

4. A stackable high-chair as recited in claim 3, wherein said intermediate horizontal member extends upward to, and is integrally formed with, said seat.

5. A stackable high-chair as recited in claim 1, wherein said restraint device includes a horizontal member having opposite ends and a center vertical member attached thereto, said seat includes substantially vertical sides, and said seat sides each having a channel to receive said restraint device horizontal member opposite ends.

6. A stackable high-chair as recited in claim 1, wherein said high-chair front space has a height of at least 6 inches, said high-chair has a vertical high-chair axis extending through the chair, wherein said axis is adapted to be normal to said floor in normal use, and said high-chair is adapted to be stacked upon another identical high-chair such that said rear horizontal member can be slid over a topmost extent of said identical high-chair without requiring including the high-chair axis more than about 30 degrees from horizontal.

7. A stackable high-chair as recited in claim 1, wherein said high-chair is adapted to be stacked upon another identical high-chair such that identical, corresponding parts of said stacked high-chairs do not form a stacking angle of more than about 20 degrees with respect to vertical.

8. A stackable high-chair as recited in claim 1, wherein said high-chair has a height, and said high-chair is adapted to be stacked upon another identical high-chair such that a height of said stacked high-chairs is not more than 30% greater than the height of said high-chair.

9. A stackable, substantially monolithic, seamless transportable high-chair adapted for setting on a floor, comprising:

a seat, said seat comprising a substantially horizontal seating surface, wherein said horizontal seating surface is adapted to be at distance from the floor such that when a child is sitting in said high-chair, feet of the child do not touch the floor, a substantially vertical seat back integrally formed with said horizontal seating surface, wherein said seat back includes an extended top portion including an integrally formed seat back top horizontal member and seat back side vertical members defining a space therebetween, wherein said seat back includes a channel on each side adapted to receive an extended rearward arms of a tray, said seat includes substantially vertical sides integrally formed with said seat back and horizontal seating surface, and a restraint device interconnected to said horizontal seating surface at a forward portion thereof, for inhibiting forward movement of a child sitting in said seat;

wherein said high-chair seat includes an arm rest on each side and a rear surface, said high-chair arm rests adapted to receive a rear surface of an identical, second high-chair slid thereover;

at least two substantially vertical side members integrally formed with said seat, said vertical side members defining a front space therebetween, said space having a substantial height for extending to said floor;

at least two substantially horizontal side members integrally formed with said vertical side members wherein said high-chair vertical and horizontal members are adapted to receive vertical and horizontal members of an identical, second high-chair slid thereover;

an intermediate horizontal member between said vertical side members, said intermediate horizontal member defining a top of said space and extending vertically to said seat, said intermediate horizontal member being integrally formed within said vertical side members and said seat, said intermediate horizontal member including an integrally formed foot rest surface extending forward of said vertical side members;

a rear horizontal member, said rear horizontal member adapted to lie on the floor and extending between and integrally formed with, said side horizontal members, said rear and side horizontal members define an inside clearance sufficiently large such that said high-chair is able to be stacked upon a second, identical high-chair, wherein said high-chair front space has a height of at least 6 inches, said high-chair has a vertical high-chair axis extending through the high-chair wherein said axis is adapted to be normal to said floor in normal use, and said high-chair is adapted to be stacked upon another identical high-chair such that said rear horizontal member can be slid over a topmost extent of said identical high-chair without requiring inclining the highchair axis more than about 30 degrees from horizontal, wherein said high-chair is adapted to be stacked upon said identical high-chair such that identical, corresponding parts of said stacked high-chairs do not form a stacking angle of more than 20 degrees with respect to vertical, wherein said high-chair has a height, and said high-chair is adapted to be stacked upon said identical high-chair such that a height of said stacked high-chairs is not more than 30% greater than the height of a said high-chair; and at least one wheel interconnected to an elevated rearward portion of said rear horizontal member, wherein in a normal position of use said wheel is elevated above said floor to prevent the inadvertent movement of said high-chair and when a forward portion of said high-chair is elevated said wheel engages said floor to permit transportation of said high-chair.

10. A stackable high-chair as recited in claim 9, wherein said restraint device includes a horizontal member having opposite ends and a center vertical member attached thereto, and said seat sides each having a channel to receive said restraint device horizontal member opposite ends.

* * * * *